US007114571B2

(12) United States Patent
Gatherar et al.

(10) Patent No.: US 7,114,571 B2
(45) Date of Patent: Oct. 3, 2006

(54) DEVICE FOR INSTALLATION AND FLOW TEST OF SUBSEA COMPLETIONS

(75) Inventors: Nicholas Gatherar, Juniper Green (GB); Graeme John Collie, Dunfermline (GB)

(73) Assignee: FMC Technologies, Inc., Houston, TX (US)

( * ) Notice: Subject to any disclaimer, the term of this patent is extended or adjusted under 35 U.S.C. 154(b) by 261 days.

(21) Appl. No.: 10/276,111

(22) PCT Filed: Apr. 24, 2001

(86) PCT No.: PCT/GB01/01817

§ 371 (c)(1),
(2), (4) Date: Oct. 21, 2002

(87) PCT Pub. No.: WO01/88331

PCT Pub. Date: Nov. 22, 2001

(65) Prior Publication Data

US 2003/0145994 A1 Aug. 7, 2003

(30) Foreign Application Priority Data

May 16, 2000 (GB) ..... 0011793.7

(51) Int. Cl.
*E21B 17/01* (2006.01)
*E21B 33/043* (2006.01)
*E21B 43/013* (2006.01)

(52) U.S. Cl. ..... 166/367; 166/338; 166/77.1; 166/89.2

(58) Field of Classification Search ..... 166/336, 166/367, 88.1, 89.2, 77.1, 77.2
See application file for complete search history.

(56) References Cited

U.S. PATENT DOCUMENTS

| | | | | |
|---|---|---|---|---|
| 3,737,857 | A | 6/1973 | Carmen | |
| 4,368,871 | A | 1/1983 | Young | |
| 4,375,239 | A | 3/1983 | Barrington et al. | |
| 4,658,904 | A * | 4/1987 | Doremus et al. | 166/336 |
| 4,825,953 | A | 5/1989 | Wong et al. | |
| 4,993,492 | A | 2/1991 | Cressey et al. | |
| 5,002,130 | A | 3/1991 | Laky | |
| 5,582,438 | A | 12/1996 | Wilkins et al. | |
| 5,941,310 | A | 8/1999 | Cunningham et al. | |
| 5,960,885 | A * | 10/1999 | Edwards et al. | 166/345 |
| 6,715,554 | B1 * | 4/2004 | Cunningham et al. | 166/348 |

FOREIGN PATENT DOCUMENTS

| | | |
|---|---|---|
| EP | 0 545 551 A2 | 6/1993 |
| EP | 0 572 732 B1 | 8/1998 |
| GB | 2 269 841 A | 2/1994 |
| GB | 2 321 658 A | 8/1998 |
| GB | 2 342 368 A | 4/2000 |

* cited by examiner

*Primary Examiner*—David Bagnell
*Assistant Examiner*—Shane Bomar
(74) *Attorney, Agent, or Firm*—Henry C. Query, Jr.

(57) ABSTRACT

A running string for a subsea completion comprises an upper section (70) which may be a coiled tubing (CT) injector unit as shown, or a wireline lubricator (FIG. 8). A lower section (60) provides wireline/CT access to production/annulus bores of a tubing hanger (not shown) attached to tubing hanger running tool (62). A flow package (64) in the lower section (60), together with BOP pipe rams (86) and annular seal (88), directs production and annulus fluid flows/pressures to the BOP choke/kill lines (78/76). The upper and lower sections allow installation and pressure/circulation testing of, and wireline/CT access to, a subsea completion, without the use of a high pressure riser.

17 Claims, 11 Drawing Sheets

(PRIOR ART)

PRIOR ART

PRIOR ART

DEVICE FOR INSTALLATION AND FLOW TEST OF SUBSEA COMPLETIONS

FIELD OF THE INVENTION

This invention relates to installation and testing of completion components such as tubing and tubing hangers in a subsea well.

INVENTION BACKGROUND

Typically tubing hanger installation for either a conventional or horizontal subsea Christmas tree system utilises a riser as a method of lowering the tubing hanger to the wellhead/Christmas tree and as a means of transporting fluids to and from the wellbore. The riser also acts as a means of transporting wireline and coiled tubing from the surface to the desired location. The typical arrangement of installation equipment is as shown in FIGS. 1*a*–1*d,* with FIG. 1*a* showing a "conventional" completion and FIG. 1*b* a horizontal completion. In FIG. 1*a,* a BOP 10 is landed on and sealed to a wellhead 12. A marine riser 14 extends from the BOP 10 to a drilling vessel (not shown). The completion landing string comprising a tubing hanger (TH) 16 and associated tubing (not shown), tubing hanger running tool (THRT) 18 and tubing hanger orientation joint (THOJ) 20 is lowered into the marine riser 14 on a dual bore high pressure riser 22. A controls umbilical 24 is secured to the riser 22 and extends from the drilling vessel to the THOJ and THRT. A surface tree 26 is secured to the riser 22 for control of well fluids. The corresponding FIG. 1*b* arrangement for a horizontal tree 28 comprises a BOP 32 secured to the tree 28, and a landing string comprising a THRT 30 for TH 34, a subsea test tree (SSTT) 36, an emergency disconnect package (EDP) 38, a retainer valve 40, a monobore riser 42 and a controls umbilical 44; all run through a marine riser 46. A surface tree 48 is secured to the monobore riser 42. If required, fluid communication with the tubing annulus may be established via the BOP choke and kill lines 45, 47, or via a separate external connection (not shown).

For wireline operations, a lubricator 50 is attached to either surface tree 26 or 48, as shown in FIG. 1*c*. Similarly, a tubing injector 52, comprising a tractor unit 54 and stuffing box 56, may be attached to the surface trees 26, 48 for coiled tubing (CT) operations.

The high pressure riser system represents a sigificant proportion of the installation equipment total cost and can, in the case of small projects, significantly affect the profitability of individual wells. Historically the riser systems, which are usually purpose designed pipe-pipe coupling equipment, are regarded as non-reusable and have long lead times to design and produce for each project. In the case of deepwater wells the time to run equipment can significantly affect the overall installed cost of a well. Furthermore, although some investigations into riserless drilling of the well have been carried out, completion equipment currently in use requires a high pressure riser for instaltion of the tubing hanger. This negates some of the cost savings available from riserless drilling. Therefore elimination of the riser system will significantly reduce project costs and lead times.

For deep water applications, a dynamically positioned installation vessel is typically used and emergencies concerning vessel station keeping are more likely to arise. This is of partcular concern during extended well flow testing. It is desirable to improve speed and reliability of emergency disconnection of the riser system from the BOP.

U.S. Pat. No. 5,941,310 (Cunningham) discloses a monobore completion/intervention riser system, providing a conduit for communicating fluids and wireline tools between a surface vessel and a subsea well. A ram spool is provided, engageable by BOP pipe rams, to establish fluid communication between an annulus bore and a choke and kill conduit in the BOP.

U.S. Pat. No. 5,002,130 (Laky) and U.S. Pat. No. 4,825,953 (Wong) disclose open water, subsea CT injectors and wireline lubricators, but do not suggest the use of such equipment in subsea completion operations, which normally utilise a BOP and marine riser attached to the wellhead.

SUMMARY OF THE INVENTION

The present invention provides a flow package for installation and testing of subsea completions having an elongate body connected to or comprising a tubing hanger running tool; the flow package body is engageable by pipe rams or annular seals of a BOP in use, a first end of a fluid flow conduit extending through the tubing hanger running tool for connection with a production or annulus bore in a tubing hanger; a second end of the fluid flow conduit being connected to a port in the side or upper end of the flow package body, whereby a sealed flow connection is formed between a choke and/or kill line of the BOP and the port; characterised in that the flow package comprises a wireline lubricator or coiled tubing injector installable within a marine riser and mounted to the upper end of the flow package body, thereby eliminating the need for a high pressure riser for well fluid transport. The flow package thus may be used to establish a flow path between the tubing hanger production or annulus bore and the BOP choke or kill lines. Two such fluid flow conduits may be provided, having their respective first ends connectable to production and annulus bores in a parallel bore tubing hanger, and their associated ports connectable to respective ones of the BOP choke and kill lines by engagement of the BOP pipe rams/seals with the flow package body. When provided with a single flow conduit, the flow package may be used to connect the vertical production bore of a horizontal tubing hanger to a choke or kill line of the BOP, preferably the choke line.

The prior art arrangement requires the completions riser to be disconnected, followed by disconnection of the marine riser. The invention allows the installation string to be removed and the BOP rams to be closed above the flow package prior to commencement of well flow testing. This facilitates a simpler, more reliable and rapid disconnection at the marine riser in an emergency, e.g. when the installation vessel is driven off station.

Advantageously, the or each flow conduit has an upper end providing wireline or CT access to its associated tubing hanger bore. The flow conduit(s) may contain valves providing flow control and wireline/CT shearing capabilities.

The wireline lubricator or coiled tubing injector may be mounted to the upper end of the flow package body by a remotely actuable connector, allowing substitution between the lubricator and CT injector. Where two flow conduits are provided in the flow package body, the connector may provide for mounting of the lubricator/CT injector in two different orientations, for connection with alternative ones of the flow conduits. Alternatively, a bore selector may be connected between the flow package body and the lubricator or CT injector. The coiled tubing injector and/or wireline lubricator may be connected directly to the flow package body or bore selector.

A service line umbilical to the flow package may be run and retrieved together with the flow package, wireline lubricator or CT injector, inside a marine riser connected to the BOP. Alternatively, the service line umbilical may be located outside the marine riser, being connectable and disconnectable from the flow package by a remotely actuable penetrator mounted on the BOP.

Additionally, or as a further alternative, an electrical/optical controls line may be incorporated in the umbilical, whether inside or outside the marine riser. This controls line may be used in conjunction with a source of pressurised fluid supplied to the flow package, to form an electro-hydraulic, or opto-hydraulic, multiplexed control system.

The necessary hydraulic fluid power may be supplied to the flow package via an open port in its upper part; in use BOP closure elements being closed and sealed around the flow package body to define a pressurisable space in communication with the open port.

The controls system thus reduces or even entirely eliminates the number of fluid lines in the service line umbilical. It may be used to control the following hydraulically actuated functions of the flow package:

Latching/unlatching of the THRT to the TH (including hydraulic pull/push for powered connection/disconnection);

Actuation of the flow control valves in the flow package;

TH seal energization and lockdown, or TH retrieval;

Actuation of other equipment attached to the tubing hanger and tubing string, e.g. annulus valves, downhole safety valves, downhole control valves or chemical injection valves.

The controls system may also be used to provide feedback concerning the operating state e.g. of any of the controlled components. For example, appropriate position sensors can be connected to the various valves and actuators concerned, providing electrical or optical signals which are fed (if necessary with suitable multiplexing) back up the controls line.

In a yet further embodiment, the control and feedback signals may be sent acoustically, e.g. through the wireline, CT or drill pipe upon which the flow package is suspended. For this purpose, either or both the surface equipment and the flow package may include appropriate acoustic signal generating and receiving equipment. The flow package will use the received electrical, optical or acoustic signals to control solenoid valves, selectively controlling the supply of pressurised fluid to the flow control valve actuators. It will also generate acoustic feedback signals indicative of actuator positions or other operative conditions of interest. The flow package may incorporate an internal electric power supply, so that when acoustic signal transmission is used, no electrical connection to the surface is required. Alternatively, a single electrical connection to the surface may be provided for powering the solenoids and acoustic signal receiving/generating equipment.

The invention thus provides apparatus that eliminates the riser system during installation of a tubing hanger for any subsea completion design (e.g. dual bore conventional). This has the following benefits:

1. For a horizontal subsea Christmas tree system no riser is required.
2. For a conventional subsea Christmas tree system a riser would only be required for installation/workover if coiled tubing through the Christmas tree were needed.
3. Elimination of the riser reduces project costs and potentially installation times and costs.
4. Coiled tubing operation could be performed during tubing hanger installation and thereby eliminate the use of an open water riser for coiled tubing operations during Christmas tree installation.
5. In the event of a vessel drive off or drift off scenario, the marine riser may be disconnected more rapidly due to the absence of the internal completions riser.

The invention including further preferred features and advantages is described below with reference to illustrative embodiments shown in the drawings.

DESCRIPTION OF THE PREFERRED EMBODIMENTS

Figure 1A:
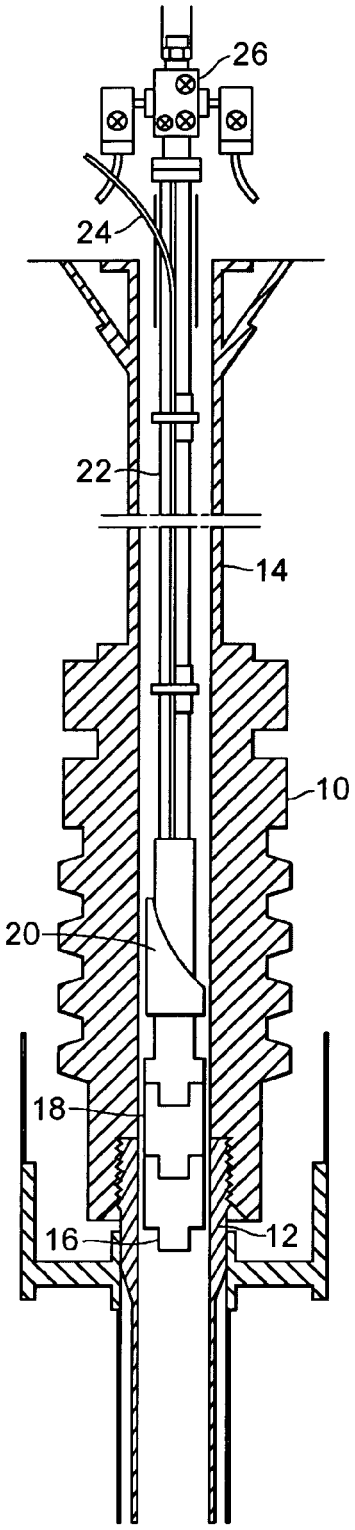
FIGS. 1*a*–1*d* show prior art completion installation equipment as discussed as background above.
Figure 1B:
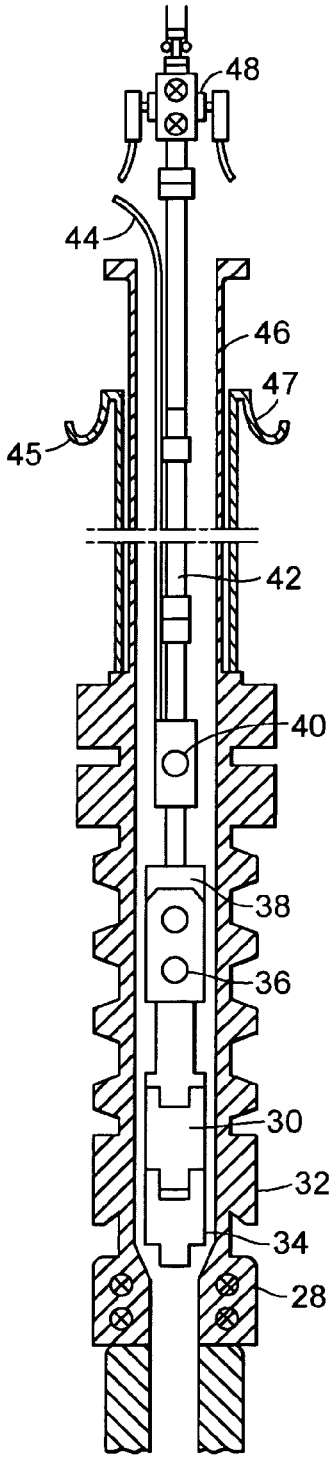
(PRIOR ART) Fig. 1b.
Figure 1C:
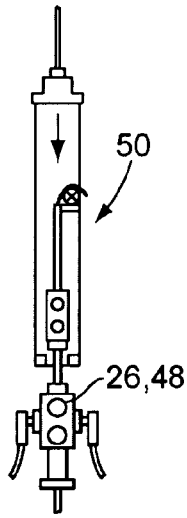
(PRIOR ART) Fig. 1c.
Figure 1D:
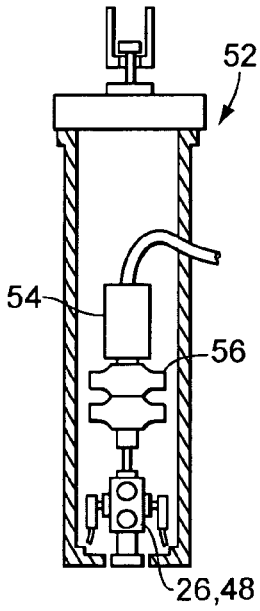
(PRIOR ART) Fig. 1d.
Figure 2:
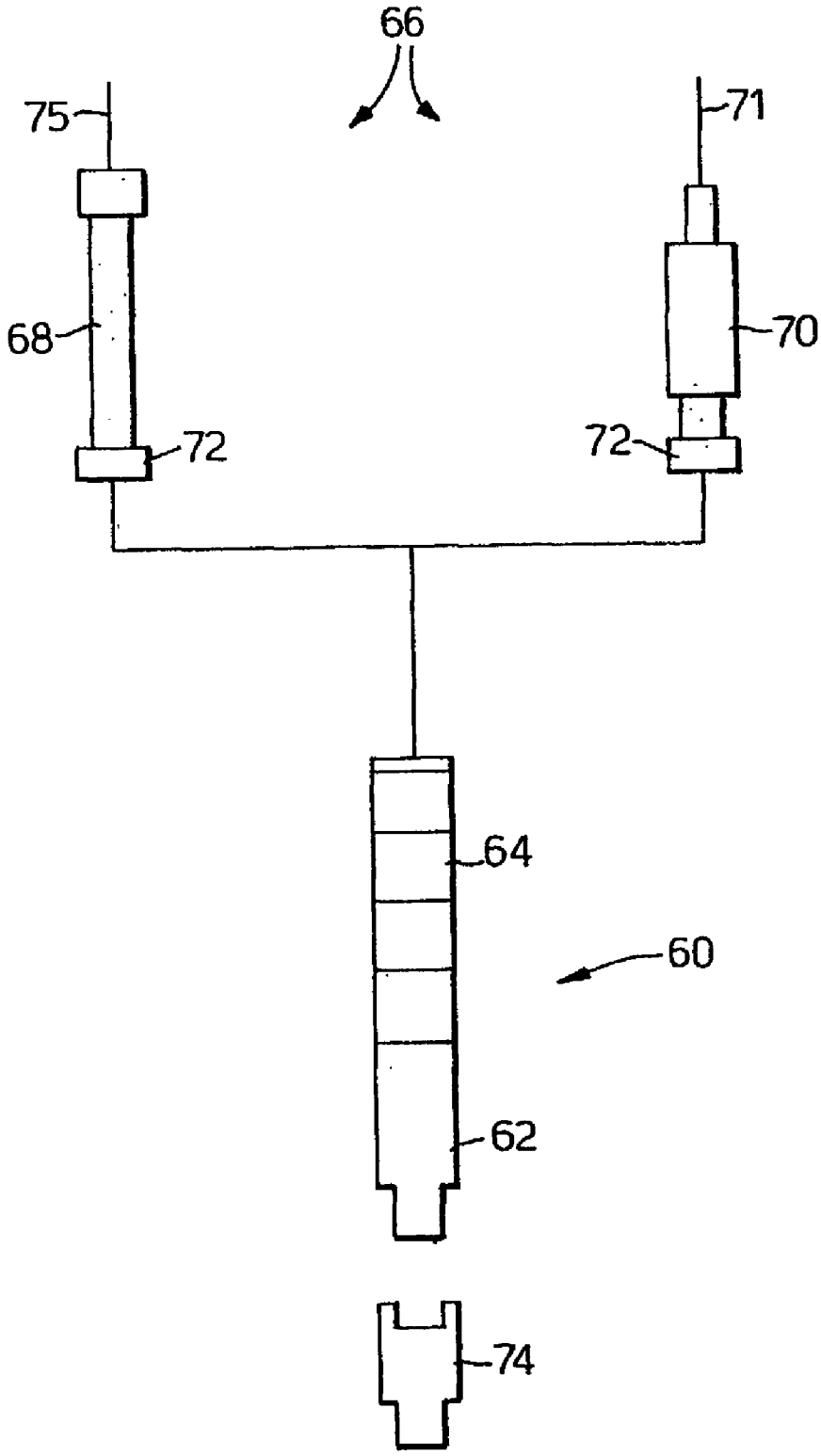
FIG. 2 shows the basic configuration of a flow package, THRT and wireline lubricator/CT injector embodying the invention.

The overall landing string assembly shown in FIG. 2 has two major sections: a lower section 60 comprising a THRT 62 attached to the flow package 64; and interchangeable upper sections 66 comprising a wireline lubricator 68 and coiled tubing injector 70 as required. The flow control package 64 acts as a wireline or coiled tubing BOP, similar to a surface equivalent. A remotely operable latch unit 72 permits the upper section of the landing string to be unlocked and retrieved to the surface for change out of wireline tools and coiled tubing 71. The THRT 62 is engageable with a tubing hanger 74 for TH installation, completion testing and wireline/CT operations.

Figure 3:
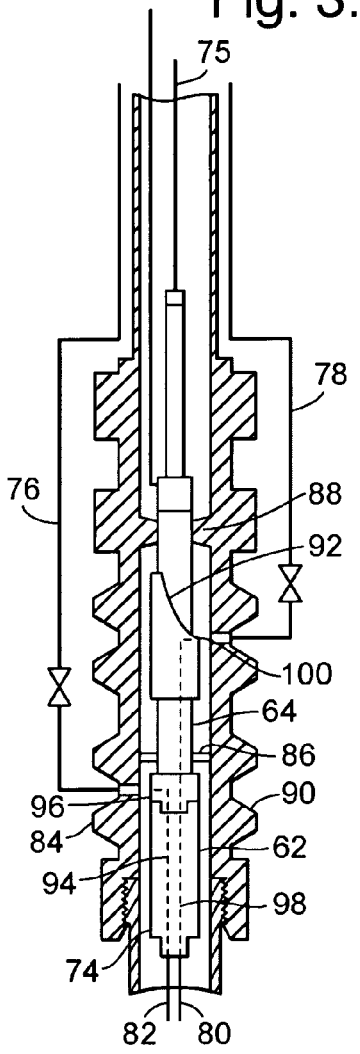
FIG. 3 shows a TH, THRT, flow package and wireline lubricator embodying the invention landed in a BOP.

As shown in FIG. 3, the BOP choke lines 78 may serve as a flow path to the production bore 80 and the BOP kill lines 76 as a flow path to the annulus bore 82 of a dual, parallel bore completion. Valves in the flow control package 64 preferably control the flow, with the BOP 90 using its pipe rams 86 and annular seal bags 88 to seal against the landing string and thus provide pressure continuity. The tubing hanger 74 is attached to the landing string, which is lowered to the wellhead on a wireline 75, chain, drill pipe, coiled tubing 71 or the like. The landing string assembly may include an orientation helix 92 which interacts with a per se known orientation pin or key projecting from the interior wall of the BOP 90. Once the tubing hanger 74 is landed and locked, the BOP 90 closes its appropriate rams 86 and annulus seals 88 to provide continuity of the annulus and production bores. The annulus conduit 94 in the flow package 64 terminates at a port 96 in the side of the flow package 64 body. This port 96 comnunicates with the annular void defined between the flow package 64, TBRT 62, TH 74, pipe rams 86 and surrounding BOP 90. The kill line 76 also communicates with that annular void to complete the annulus flow path. Similarly, a production conduit 98 in the flow package 64 terminates at a port 100, which communicates with the annular void defined between the landing string, pipe rams 86, BOP annular seal 88 and BOP 90. The choke line 78 communicates with the latter void to complete the production flow path.

Final completion of the well (e.g. installation of the Christmas tree) may be performed using known methods, such as subsea wireline lubricators etc.

Figure 4A:
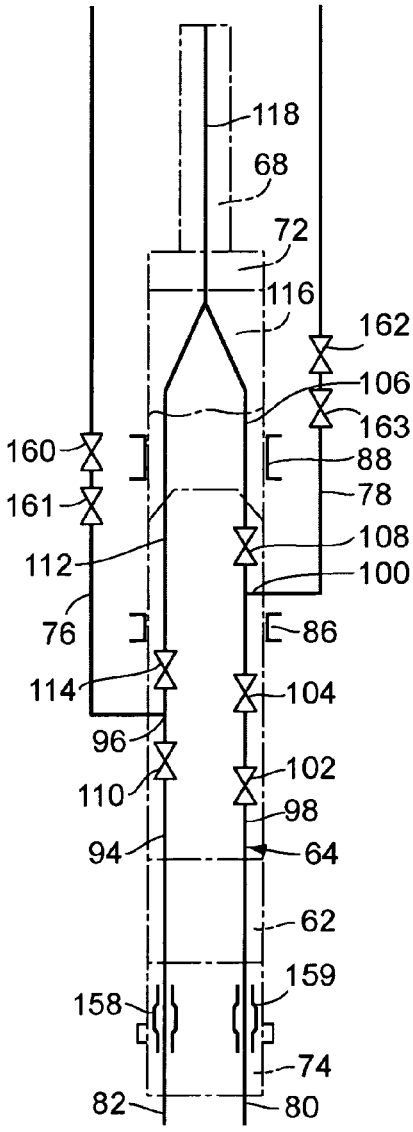
FIG. 4*a* is a diagram showing fluid flow paths, control valves and wireline access paths for a flow package embodying the invention, used with a wireline lubricator in a parallel bore conventional completion.
Figure 8:
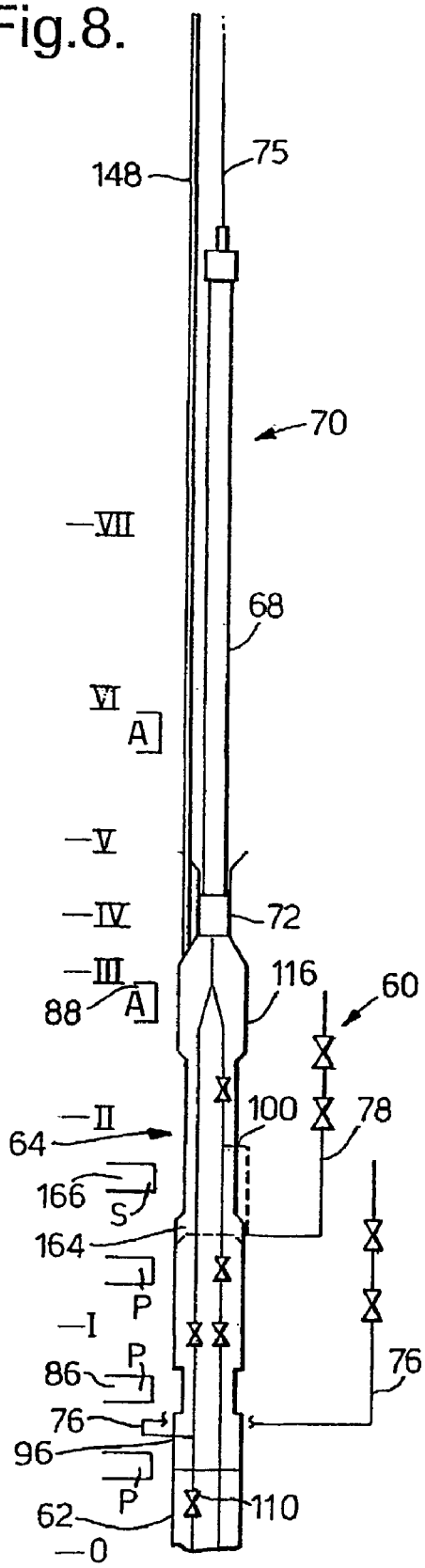
FIG. 8 illustrates the relationship, in use, between a flow control package/wireline lubricator embodying the invention and the sealing components of a typical BOP.

The flow control package provides pressure containment and cutting facilities for example as shown in FIGS. 4*a,* 4*b* and 5. For the dual parallel bore completion shown in FIG. 4*a,* flow control valves 102, 104 are provided in the production conduit 98 below the port 100. At least one of these valves (e.g. valve 102) may provide cutting capability. A generally vertical continuation 106 of the production conduit 98 extends to the top of the flow control package 64 to provide wireline/CT access to the production bore 80. Conduit continuation 106 contains a valve 108. Similarly, annulus conduit 94 has a valve 110, and an access continuation 112 above the port 96, containing a cutting valve 114. Valve 110 may either be positioned as shown in FIG. 4*a,* outside the THRT section 62 of the flow package 64, or inside the THRT section as indicated in FIG. 8. Other valve arrangements will be readily apparent. For example, in particular circumstances certain valves may be redundant and can be omitted. Indeed, it may be possible to eliminate all of the flow control package valves and rely entirely upon the valves in the BOP. Additionally or alternatively, the valves may be replaced by other closure elements such as wireline installed plugs.

Figure 4B:
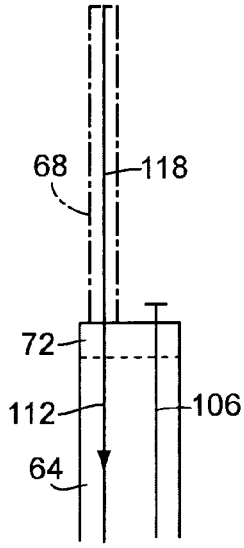
FIG. 4*b* illustrates a modification of the apparatus of FIG. 4*a;*

A bore selector 116 may be mounted on top of the flow package to provide selective access from the single bore 118 in the wireline lubricator 68 (or CT injector, not shown) to conduit continuation 106 or alternatively conduit continuation 112. The same function may be achieved by arranging the latch unit 72 to connect directly to the flow package 64 in two possible orientations. In one of these, as shown in FIG. 4*b,* the lubricator (or CT injector) bore 118 connects with the annulus conduit continuation 112 and the production conduit continuation is blanked off. In the other latch unit orientation (not shown), bore 118 is connected to continuation 106 and continuation 112 is blanked off.

Figure 5:
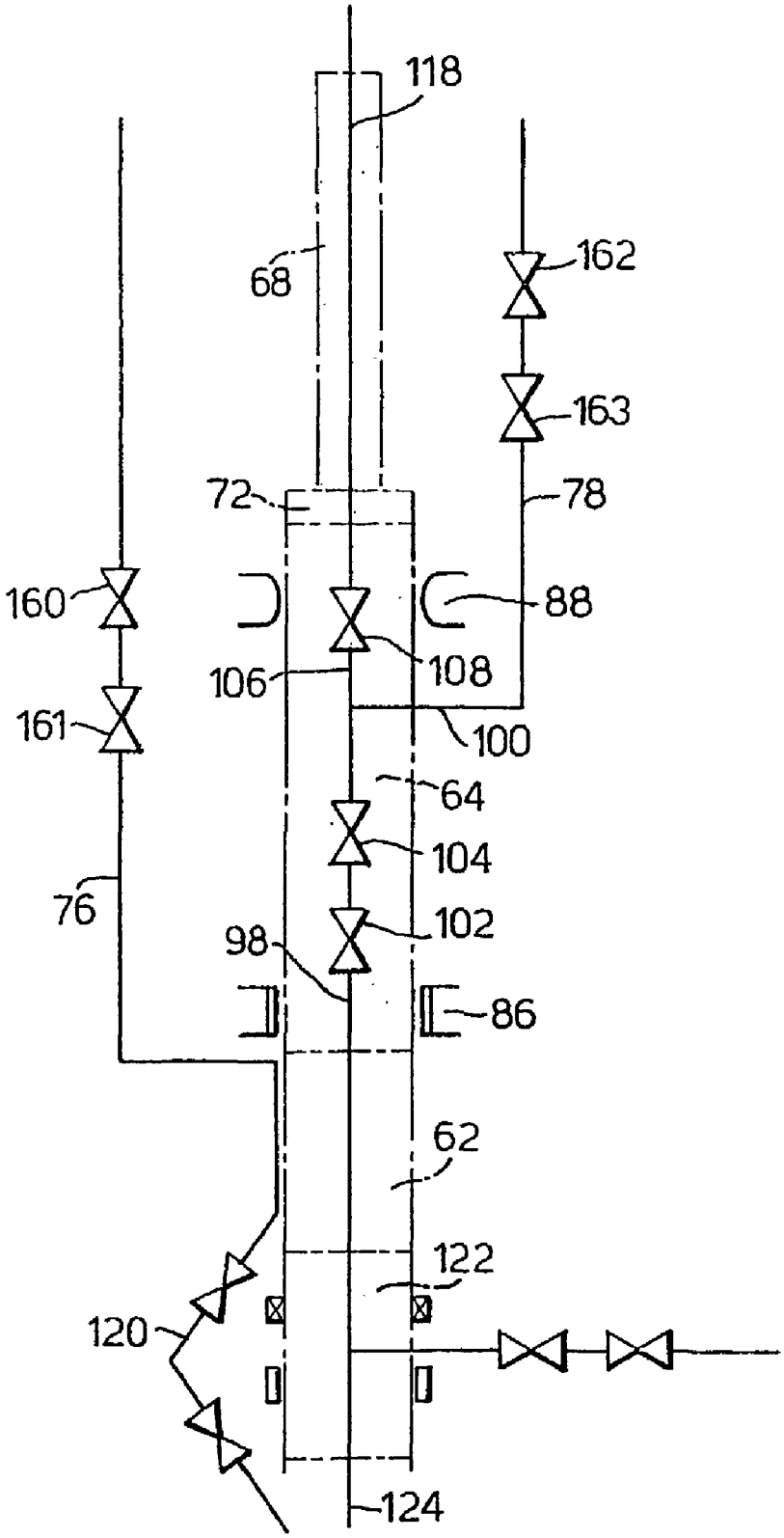
FIG. 5 corresponds to FIG. 4*a* but relates to a horizontal completion.

FIG. 5 shows the equivalent flow control/access arrangements for a horizontal completion. The annulus bypass loop 120 present in the horizontal tree to provide fluid communication with the tubing annulus, bypassing tubing hanger 122, is connected to the BOP kill lines 76 in per se known manner by closing the BOP pipe rams 86. The port 100, and hence production tubing 124, is sealed in fluid communication with the BOP choke lines 78 by closing the BOP pipe rams 86 and annular seal 88.

Figure 6:
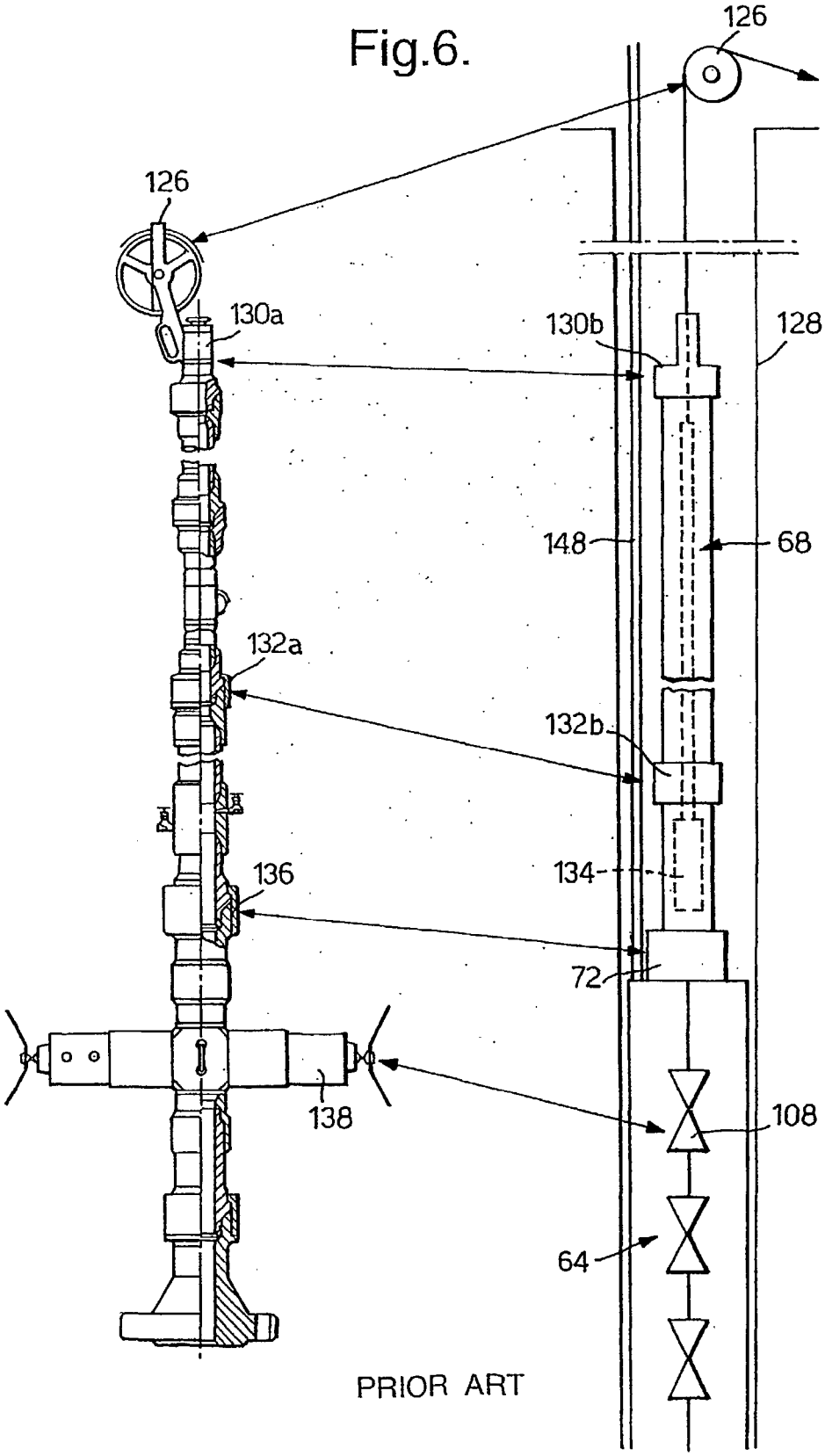
FIG. 6 is a comparative illustration of a prior art surface wireline lubricator and a flow package and lubricator embodying the invention.

FIG. 6 compares a prior art surface wireline lubricator shown on the left, with a wireline lubricator 68 and flow package 64 embodying the invention, shown on the right. Each comprises a wireline pulley or sheave 126 supported on the drilling vessel. Instead of being directly attached to the pulley 126 as in the prior art, the remainder of the lubricator and flow package of the inventive embodiment is run into the marine riser 128 to land the flow package 64 within the BOP (not shown), eliminating the high pressure riser. Both lubricators comprise a respective stuffing box 130*a,* 130*b,* and respective upper quick unions 132*a,* 132*b* for tool changeout. (A tool 134 is shown in phantom on the right hand side of the figure, contained wholly within the assembly, to protect it during trip in/trip out operations). The hydraulic latch 72 of the inventive embodiment corresponds to the lower quick union 136 of the prior art lubricator. The prior art wireline valve 138, together with the surface tree (not shown) to which the known lubricator is attached, corresponds to the flow package 64, with wireline valve 138 corresponding to valve 108. Hydraulic and/or electrical service lines to the latch 72 and flow package valves are provided via an umbilical 148.

Figure 7:
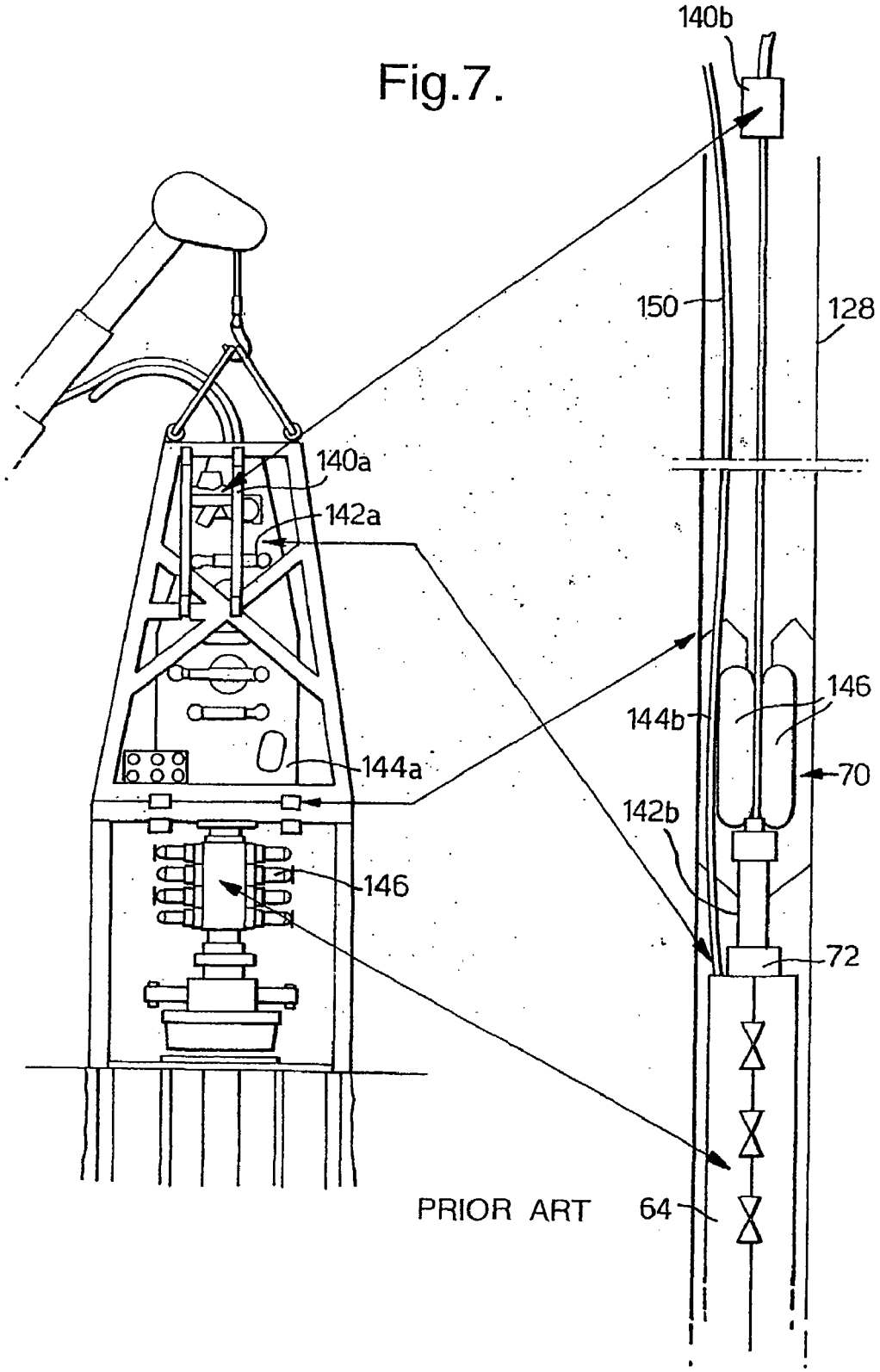
FIG. 7 is a comparative illustration of a prior art CT injector and a flow package and CT injector unit embodying the invention.

Similarly, FIG. 7 compares a prior art tubing injector unit (left) with an injector unit and flow package embodying the invention (right). Each comprises respective tubing guide and straightener rollers 140*a,* 140*b* supported on the drilling vessel. Again the remainder of the inventive injector unit 70 and flow package 64 is lowered into the marine riser 128, instead of being supported on the drilling vessel. The respective injector units comprise stuffing boxes 142*a,* 142*b* and tractor units 144*a,* 144*b.* To fit within the marine riser 128, the tubing engaging caterpillar tracks 146 and the associated drive motors of the tractor unit 144*b* must be made somewhat smaller than is conventional. However, any resulting power loss is at least partially offset by the fact that the inventive tractor unit 144*b* is situated very close to the wellhead in use, and does not have to push the CT through a high pressure riser. Prior art surface tree 146 corresponds to the flow package 64. Hydraulic and/or electrical service lines to the tractor unit 144*b,* latch 72 and flow package valves are provided via an umbilical 150. The equipment can be controlled using a direct hydraulic/electrical system or an electro-hydraulic multiplexed control system.

FIG. 8 shows the lubricator 68, bore selector 116, flow package 64 and THRT 62 stackup relative to the components of a typical BOP. In this figure, the BOP pipe rams are referenced P, BOP shear rams S and BOP annular seal bags A. Datum line 0 represents the level of the top of the wellhead; 0–I is the BOP lower double ram housing; I–II the BOP upper double ram housing, II–III the BOP lower annular seal housing; III–IV a spacer section; IV–V a BOP connector; V–VI the BOP upper annular seal housing and VI–VII the marine riser flex joint. Line VII represents the interface between the flex joint and the marine riser proper.

Figure 9A:
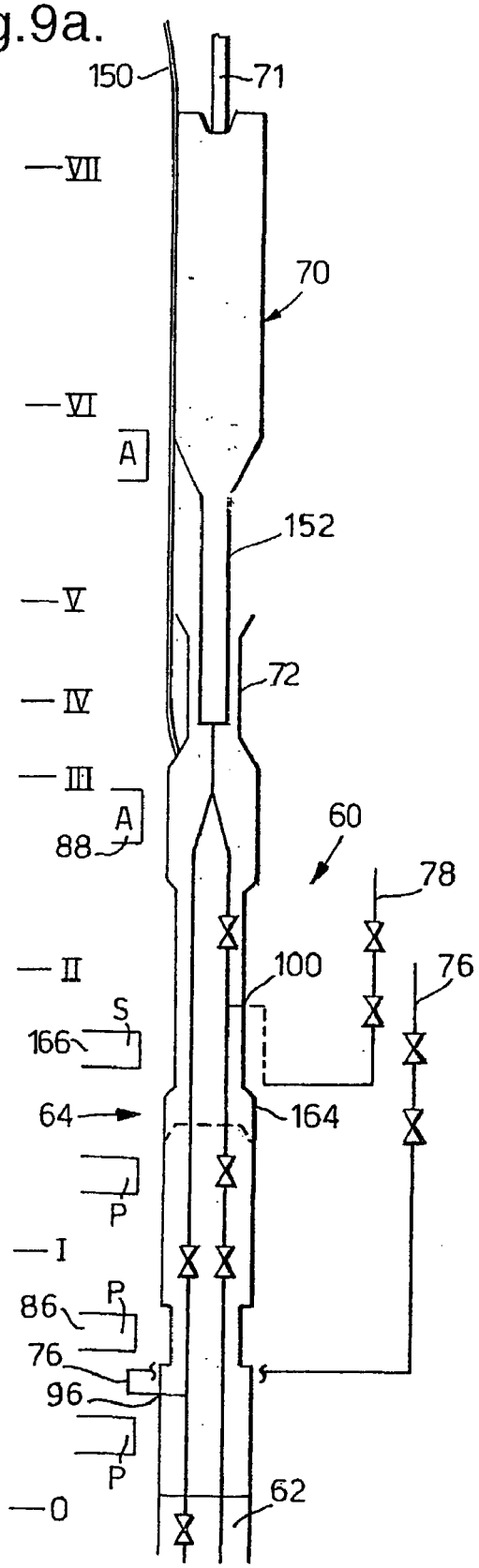
FIG. 9*a* corresponds to FIG. 8, but is for a flow control package/CT injector embodying the invention.
Figure 9B:
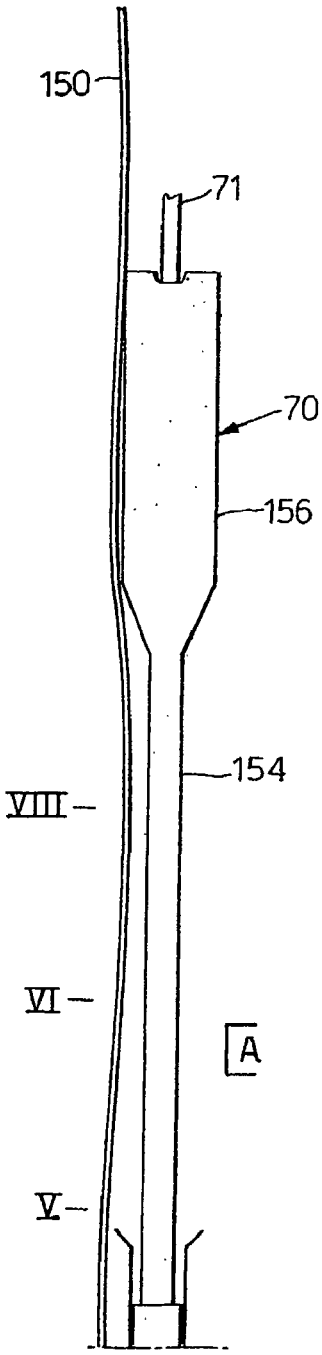
FIG. 9*b* shows a modification of the apparatus of FIG. 9*a;*

FIG. 9*a* shows an equivalent stackup for a CT injector 70, flow package 64 and THRT 62. FIG. 9*b* is a modification of FIG. 9*a,* in which a relatively short lower neck 152 on the injector unit 70 is replaced by a longer flexible neck 154 extending through the BOP/riser flex joint at VI–VII, so that the main body 156 of the injector 70 lies in the marine riser proper.

Figure 10A:
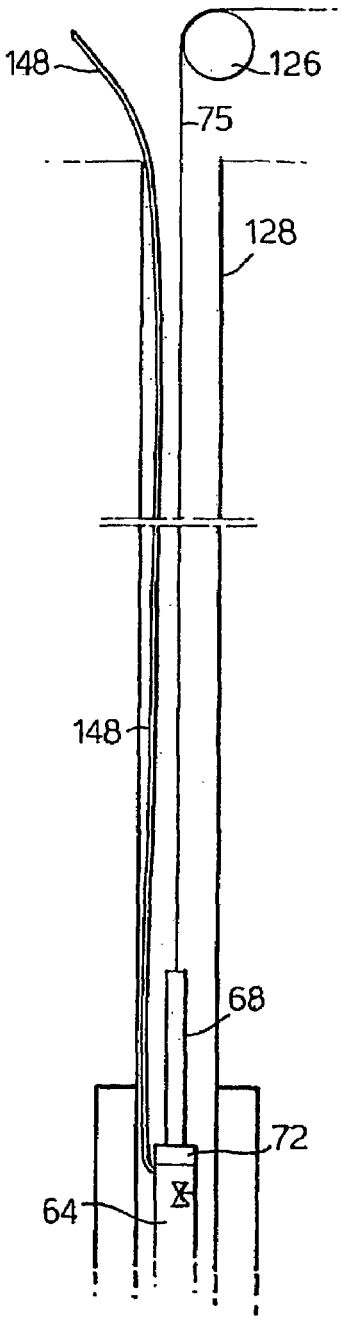
FIGS. 10*a* to 10*c* show arrangements for running and retrieving components of a flow control package/wireline lubricator embodying the invention.
Figure 10B:
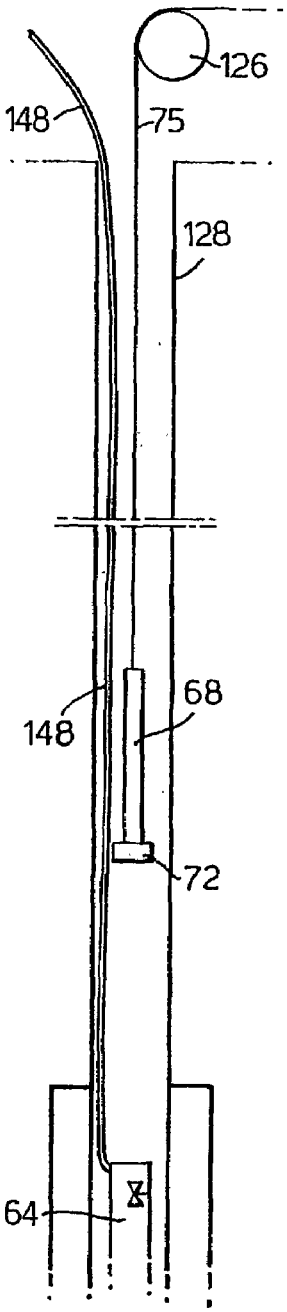
Figure 10C:
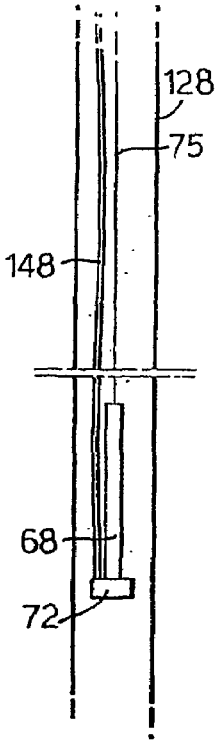

The landing string assembly can be run on a wireline or alternatively on coiled tubing or drill pipe (depending upon loading). The upper section (wireline lubricator or tubing injector unit) may not have to be run during the initial installation. It need only be run when ready to perform the first wireline trip/coiled tubing operation. FIG. 10*a* shows a wireline lubricator 68/flow package 64 assembly run and retrieved together on a wireline 75. FIG. 10*b* shows the lubricator 68 retrieved on the wireline 75, separately from the flow package 64. This flow package may either be installed coupled to the lubricator 68 or installed separately by wireline (not shown) or by being lowered on the umbilical 148. FIG. 10*c* shows a modification in which the umbilical 148 is run and retrieved together with the lubricator section 68. (Umbilical 150 can likewise be modified for installation/retrieval with the injector unit 70.) One possible alternative to lowering the tubing/landing string or separate upper and lower sections is to use a 'piston effect', allowing the assembly or section to free-fall at a slow speed in the marine riser 128, as the fluid in the riser is throttled between the assembly/section outside diameter and the riser bore. For this purpose, the component or assembly may be provided with a collar, fairly closely fitting within the marine riser bore and including a through passage with a descent control throttle valve.

Referring again to FIGS. 4*a* and 5, the following table shows various flow or access paths established and pressure/flow/circulation tests performed on a dual parallel bore completion and a horizontal completion respectively, using a flow package embodying the invention. "O" denotes the relevant barrier component in the open or unsealed condition and "●" the closed or sealed condition.

| | | Valves | | | | | | | Pipe | Annular | | |
|---|---|---|---|---|---|---|---|---|---|---|---|---|
| | | | | | | | 160 | 162 | ram | seal | TH plugs | |
| Completion | Test/Operation | 102 | 104 | 108 | 110 | 114 | 161 | 163 | 86 | 88 | 158 | 159 |
| Dual Parallel Bore (FIG. 4a) | Flow/pressure production bore (well test) | ○ | ○ | ● | ● | ● | ● | ○ | ● | ● | ○/● | ○ |
| | Flow/pressure in annulus | ● | ● | ● | ○ | ● | ○ | ● | ● | ○/● | ○ | ○/● |
| | Downhole circulation | ○ | ○ | ● | ○ | ● | ○ | ○ | ● | ● | ○ | ○ |
| | Circulation choke/kill | ○/● | ● | ● | ● | ● | ○ | ○ | ○ | ● | ○/● | ○/● |
| | Wireline and CT access to production bore* | ○ | ○ | ○ | ● | ● | ● | ● | ● | ● | ○/● | ○ |
| | Wireline access to annulus bore | ○/● | ○/● | ○/● | ○ | ○ | ○/● | ○/● | ○ | ○ | ○ | ○/● |
| | Testing TH plugs from above | ○ | ○ | ● | ○ | ● | ○ | ○ | ● | ● | ● | ● |
| | Alternative TH plug test† | ● | ○/● | ○/● | ● | ○/● | ○/● | ○/● | ○/● | ○/● | ● | ● |
| Horizontal (FIG. 5) | Flow/pressure in production bore (well test) | ○ | ○ | ● | | | ● | ○ | ● | ● | | |
| | Flow/pressure in Annulus** | ● | ● | ● | | | ○ | ● | ● | ○/● | | |
| | Downhole circulation** | ○ | ○ | ● | | | ○ | ○ | ● | ● | | |
| | Circulation choke/kill | ○/● | ● | ● | | | ○ | ○ | ○ | ● | | |
| | Wireline and CT access to production bore | ○ | ○ | ○ | | | ● | ● | ● | ● | | |

*Bore selector 116 or latch unit 72 aligned for production bore access.
†Using dedicated test ports for conduits 94, 98 in THRT 62 or flow package 64, below valves 102, 110, and each connected to a test line in umbilical 148 or 150.
**Valves in annulus bypass loop 120 open.

Figure 11:
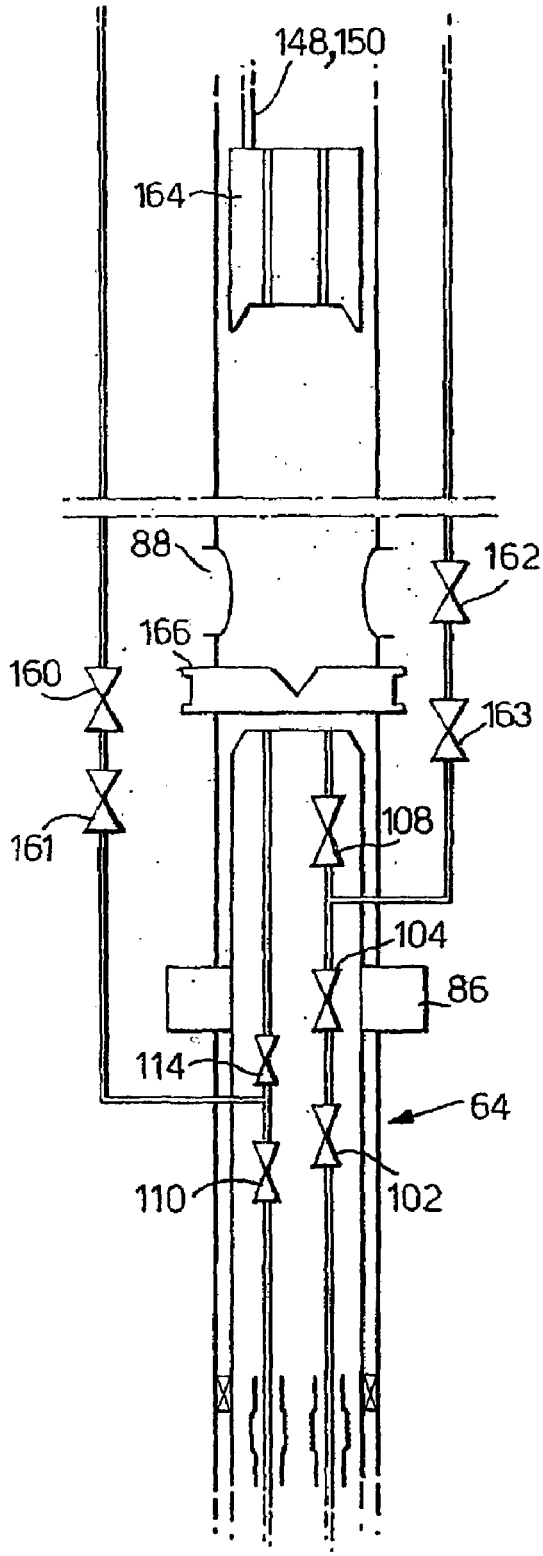
FIG. 11 is a diagram illustrating a BOP emergency shear disconnect (ESD) operation.

The flow package 64 preferably incorporates an emergency disconnect package (EDP) 164 at its upper end (FIGS. 8, 9*a*, 11). In an emergency requiring rapid disconnection of the marine riser from the wellhead, the flow package valves 102, 104, 108, 110, 114, choke/kill line valves 160, 161, 162, 163 and BOP pipe rams 86 are closed, with e.g. valves 102, 114 used to shear any wirelines, CT or the like passing into the completion. Latch means are then released to disconnect the EDP 164 from the remainder of the flow package 64. The EDP and attached umbilical 148 or 150, and any attached upper section (wireline lubricator or CT injector such as 68, 70, FIG. 2) may then be pulled, the BOP shear rams 166 closed and the BOP connector at IV–V in FIGS. 8, 9*a* or 9*b* released. The EDP latch means may be mechanically actuated for release by the BOP shear rams 166, and/or may be hydraulically actuated. Where the umbilical 148, 150 is retrievable with the upper section latch connector 72 as shown in FIG. 10*c*, or where the umbilical is connected to the lower section 60 by a horizontal penetrator assembly (described in more detail below with reference to FIG. 13), it may be possible to disconnect at the latch 72 to leave the entire lower section behind at the wellhead, particularly when wireline/CT cutting is not required. In that case the BOP pipe rams and/or annular seal 88 are used to seal the BOP lower section to the landing string lower section 60 and the BOP shear rams are left open.

This variation also allows for the EDP 164 to be deliberately disconnected before commencement of the flow test. The shear rams may be closed above the disconnection point as shown in FIG. 11 to provide a barrier between the well test fluids and the bore of the riser. Control of the valves in the flow package 64 is via the horizontal penetrator assembly. It may be preferable to provide an additional barrier to the produced fluids in this scenario. This may be achieved by engaging an additional set of pipe rams above the outlet port 100 onto the outside diameter of the flow package. Alternatively, the role of the production and annulus conduits may be reversed, with the production flow being routed via port 96 and the annulus fluids being routed via port 100, thereby providing additional barriers to the produced fluids. This alternative is also applicable to the embodiments of the invention mentioned earlier.

Figure 12:
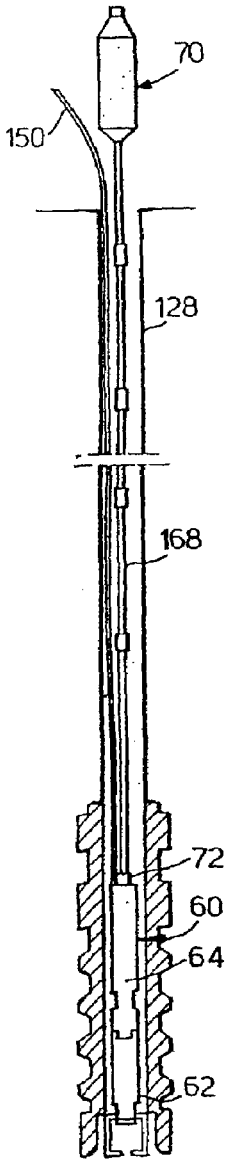
FIG. 12 shows an alternative embodiment of the invention for CT injection.

FIG. 12 shows a modified form of CT injector embodying the invention. The CT injector unit 70 is supported on the drilling vessel and is connected to the landing string lower section 60, comprising the THRT 62 and flow package 64, by drill pipe 168 run into the marine riser 128. Standard drill pipe is readily available having an internal diameter sufficient for passage of CT up to five inches (127 mm) in diameter. A wireline lubricator may likewise be surface mounted and connected by drill pipe to a flow package 64 landed in the BOP, provided that the wireline tools concerned are of sufficiently small diameter to pass through the drill pipe. In these embodiments the drill pipe serves as a cheaper and more readily available alternative to a custom designed high pressure riser system.

Figure 13:
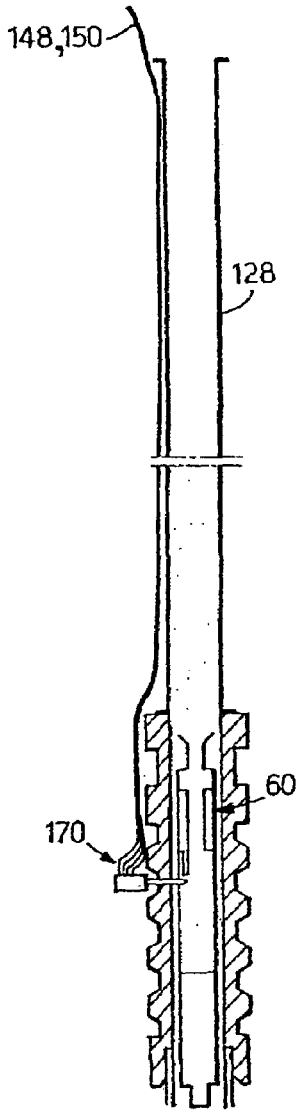
FIG. 13 shows a possible modification to the previous embodiments.

FIG. 13 concerns a modification of the previously described embodiments. As shown in FIG. 13, the umbilical 148 or 150 is attached to the outside of the marine riser, and is connected to the running string lower section 60, for example by a remotely actuated horizontal penetrator assembly 170 mounted on the BOP, when the lower section 60 is landed in the BOP. With this arrangement, there is no need to run/pull the umbilical with every tool or CT trip, thereby reducing the risk of wear and damage to the umbilical. Also, the EDP can be disconnected and the BOP shear rams closed prior to flow testing, with the flow package valves remaining fully remotely operable, as described above.

Figure 14:
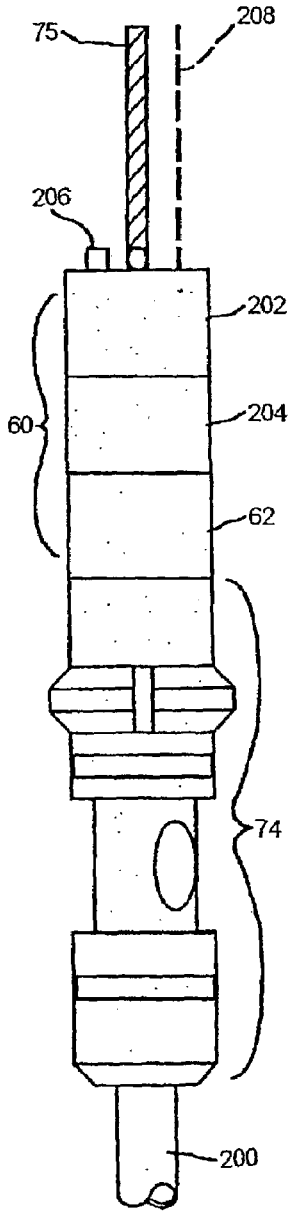
FIG. 14 is a diagram of a yet further modification, showing the flow package and attached tubing hanger.

FIG. 14 shows a further modification, in which the flow package 60 is suspended on a wireline, CT or drill pipe 75. A tubing hanger 74 and associated tubing 200 are releasably attached to the lower end of the flow package 60. As shown, the flow package is conceptually divided into a signal processing and control module 202, an actuator module 204 and a THRT 62, although it will be readily apparent that the functional components of the module 202 may be located anywhere within the flow package 60 and the actuators may be located anywhere within the flow package 60, TH 74, or tubing string 200.

An aperture or open port 206 is used to admit pressurised fluid into the upper end of the control module for powering the various actuators in the actuator module 204, the TH 74 or downhole devices. For example the annular bags 88 (or, if available, the upper pipe rams) of the BOP can be closed and sealed about the flow package body below the port 206. Fluid in the space above the annular bags may then be pressurised for use as the hydraulic power source.

Solenoid valves in the control module 202 are used for multiplexing the hydraulic power to the various actuators as required. The solenoids are connected to suitable control circuitry, supplied with control signals over an electrical or optical service line 208, extending to the surface. Service line 208 may also be used to provide electrical power to the solenoids and control circuitry. Feedback signals e.g. from valves and actuators may be transmitted back up the service line 208 to provide information at the surface concerning their operative state. Where the control and any feedback signals are instead transmitted acoustically through the wireline 75, and the control module is provided with an internal electric power supply, the service line 208 is unnecessary.

The invention claimed is:

1. A landing string assembly for installing a subsea completion through a marine riser which is connected to a BOP, the landing string assembly comprising:

a flow package which comprises an elongate body that is lowerable from a surface vessel through the marine riser and is engageable in use by at least one of the pipe rams and the annular seals of the BOP;

a tubing hanger running tool which is connected to or formed integrally with the body;

a first fluid flow conduit which extends through a portion of the body and the tubing hanger running tool and comprises a first end which is connectable with one of a production bore or an annulus bore in a tubing hanger and a second end which is connected to a first port in the body;

wherein engagement of at least one of the pipe rams and the annular seals forms a sealed flow connection between a choke or kill line of the BOP and the first port; and at least one of a wireline lubricator or coiled tubing injector which comprises a least a portion that is lowerable through the marine riser and mountable to an upper end of the body.

2. The landing string assembly of claim 1, further comprising:

a second fluid flow conduit which extends through the body and the tubing hanger running tool and comprises a first end which is connectable with the other of the production bore or the annulus bore and a second end which is connected to a second port in the body;

wherein each of the first and second ports communicates with a corresponding BOP choke or kill line by engagement of at least one of the pipe rams and annular seals with the body.

3. The landing string assembly of claim 1, wherein the first fluid flow conduit provides at least one of wireline or coiled tubing access to its associated tubing hanger bore.

4. The landing string assembly of claim 1, wherein the first fluid flow conduit comprises at least one valve which provides flow control and wireline or coiled tubing shearing capabilities.

5. The landing string assembly of claim 1, wherein the first fluid flow conduit is adapted to receive at least one wireline installed plug.

6. The landing string assembly of claim 1, wherein the wireline lubricator or coiled tubing injector is mounted to the body by a remotely actuatable connector.

7. The landing string assembly of claim 6, further comprising:

a second fluid flow conduit which extends through the body and the tubing hanger running tool and comprises a first end which is connectable with the other of the production bore or the annulus bore and a second end which is connected to a second port in the body;

wherein the connector provides for mounting the wireline lubricator or coiled tubing injector with either of the first and second fluid flow conduits.

8. The landing string assembly of claim 1, further comprising:

a second fluid flow conduits which extends through the body and the tubing hanger running tool and comprises a first end which is connectable with the other of the production bore or the annulus bore and a second end which is connected to a second port in the body;

wherein each of the first and second fluid flow conduits provides wireline or coiled tubing access to its associated tubing hanger bore; and wherein the landing string assembly further comprises a bore selector which is connected between the body and the wireline lubricator or coiled tubing injector.

9. The landing string assembly of claim 1, wherein the coiled tubing injector or wireline lubricator is located at or near the surface vessel and is connected to the body by a drill pipe string.

10. The landing string assembly of claim 1, further comprising a service line umbilical for the flow package which is located in use outside of the marine riser and is connectable to and disconnectable from the flow package by a remotely actuatable penetrator that is mounted on the BOP.

11. The landing string assembly of claim 1, wherein the flow package comprises a number of hydraulic actuators, and hydraulic fluid for operating the actuators is supplied to the flow package via an open port in an upper portion of the flow package.

12. The landing string assembly of claim 11, wherein the hydraulic fluid is multiplexed to a plurality of the actuators by a number of solenoid valves and an associated control circuit.

13. The landing string assembly of claim 12, wherein the control circuit is operated by control signals which are communicated to the control circuit over a service line that extends to the sea surface vessel.

14. The landing string assembly of claim 12, wherein the control circuit is operated by control signals which are communicated to the control circuit acoustically.

15. The landing string assembly of claim 14, wherein the acoustic control signals are transmitted from the surface vessel to the control circuit over a wireline, coiled tubing or drill pipe string from which the flow package is suspended.

16. The landing string assembly of claim 1, further comprising a number of valves and actuators, and wherein the flow package generates feedback signals which are communicated to the surface vessel to provide information relating to the operative state of the valves and actuators.

17. The landing string assembly of claim 11, wherein at least one of the BOP pipe rams and annular seals can be closed around the body to thereby define a pressurized space which communicates with the open port.

* * * * *